US005936522A

United States Patent [19]

Vogt

[11] Patent Number: 5,936,522

[45] Date of Patent: Aug. 10, 1999

[54] MULTIPLE MOVABLE WINDOWS FOR SECURITY SYSTEM SETUP AND OPERATION

[76] Inventor: William R. Vogt, 112 Jordan Rd., Rockaway, N.J. 07866

[21] Appl. No.: 09/002,215

[22] Filed: Dec. 31, 1997

[51] Int. Cl.[6] ..... G08B 13/08

[52] U.S. Cl. ..... 340/545; 340/501; 340/547; 340/556

[58] Field of Search ..... 340/545, 547, 340/501, 556, 557

[56] References Cited

U.S. PATENT DOCUMENTS

| | | | |
|---|---|---|---|
| 3,816,745 | 6/1974 | Primm et al. | 340/556 |
| 4,074,246 | 2/1978 | Conkrin et al. | 340/545 |
| 4,394,655 | 7/1983 | Wynne et al. | 340/511 |
| 4,470,047 | 9/1984 | Vogt et al. | 340/511 |
| 4,507,652 | 3/1985 | Vogt et al. | 340/501 |
| 4,507,654 | 3/1985 | Stolarczyk et al. | 340/545 |
| 5,608,207 | 3/1997 | Allen et al. | 340/556 |

*Primary Examiner*—Glen Swann

*Attorney, Agent, or Firm*—Polster, Lieder, Woodruff & Lucchesi, LC

[57] ABSTRACT

A security system (S) monitors displacement between a first unit (20) mounted on a door or window frame, and a second unit (21) mounted in the door or window, adjacent the first unit. An analog signal (Sx) created at one of the units is monitored at the other unit. A least one characteristic of the signal provides an indication as to the relative position of the units, and a nominal signal characteristic value represents a nominal position of one unit relative to the other unit for a predetermined set of conditions. On at least one side of the value is a range of signal characteristic values representing a range of acceptable motion through which one unit may move relative to the other unit without putting the system into an alarm condition. The total range of signal characteristic values representing the acceptable range of motion defines a window whose size is maintained so long as the one unit moves relative to the other unit within the window. But, if the one unit moves relative to the other unit outside the window, such movement putting the system into alarm, the size of the window is changed. The range of acceptable motion now defined by the window is a second range different from the first range. The window maintains this second range until the one unit moves to a position within the second range of acceptable motion so to take the system out of alarm.

16 Claims, 7 Drawing Sheets

MULTIPLE MOVABLE WINDOWS FOR SECURITY SYSTEM SETUP AND OPERATION

BACKGROUND OF THE INVENTION

This invention relates to a system for monitoring the relative displacement between one object and another object normally located adjacent to, or in close proximity of, the first unit. In particular, a security system uses an analog signal which may result from a magnetic field, an optical or other source to establish a window within which a movable object such as a door can move with respect to a fixed object such as the door frame without putting the system into an alarm condition; but in which an alarm condition arises should the door move outside the window. The window is a movable window which allows for automatic adjustment over time for variations between the door and frame such as are caused by changes in temperature and humidity as a result of which the physical dimensions of the door and window change. As a further refinement, the window has at least two ranges one of which is a nominal range that pertains during normal situations, and the other of which is created when the system goes into alarm.

Conventionally, security systems monitoring various possible points of entry into a facility used different types of sensors to determine whether, for example, a door is positioned adjacent its associated frame (i.e., closed), or whether the movable portion of a window is adjacent its frame or a fixed portion of the window unit (i.e., closed). Generally, these security systems use a magnetic sensor employing a reed switch or the like, and a magnet. The magnet is positioned on the door or movable portion of the window, and the reed switch on the door or window frame adjacent the magnet.). Essentially, these security or monitoring systems detect the presence, strength, and polarity of a magnetic field as an indication that a static condition (door closed) is present.

A major difficulty in making these installations is achieving the correct "balance". During installation, it has always been the job of the installer to mount the sensor in an optimum position to maximize the "catch" of the sensor, and minimize false alarms. "Catch" relates to that movement of the door relative to its frame is the maximum allowable. False alarms occur when the system is unnecessarily put into alarm (as by the door being moved relative to frame a distance which is an acceptable distance but which is outside that permitted by the particular set-up). Typically the installer monitors the normal/alarm status of the sensor as he moves one portion of the sensor back and forth relative to the other. As he does this, he notes both how close and how far he can move the one portion of the sensor to the other before he gets an alarm indication. Once he has this information, he then attempts to mount the portion of the sensor he has been moving in the middle of the two points at which an alarm would occur. A number of factors determine how "balanced" the resulting installation is. One is the competency of the installer. Another is environmental effects for which it is difficult for the installer to account. If the installation is made on a hot, humid day, the center position which the installer locates is probably going to be different than if the installation is made on a cool, dry day. What is necessary is a security system which automatically adjusts for both improper or inaccurate installation, as well as environmental effects to achieve a "balanced" sensor installation.

BRIEF SUMMARY OF THE INVENTION

Among the several objects of the present invention may be noted the provision of a security system for monitoring a premises, for example, doors and windows by which the premises can be entered by unauthorized individuals, as well as articles such as an attaché case or the like to detect unauthorized movement of the case from a storage location;

the provision of such a security system to employ analog sensors such as Hall effect devices for magnetic fields and infrared sensors for optical fields to monitor the position of a door or other object and to reliably provide a suitable indication as to whether the door is open or closed, or if an object is moved from a particular location;

the provision of such a security system which is not susceptible to defeat by unauthorized persons trying to compromise the position sensors used by the system, the provision of such a security system to employ sensors using magnetic fields or optical paths, and to automatically establish a balanced installation regardless of the type of sensor used;

the provision of such a system to use multiple windows to insure that positioning of sensing elements creates a balanced situation while setting-up the system for monitoring operations;

the provision of such a system which is an "intelligent" system that allows customization of every sensor installation, and which is responsive not only to rapid changes such as occur when a monitored door, for example, is opened, but which also is responsive to long term changes such as environmental effects;

the provision of such a system to automatically adjust the window so the window positions itself in an optimum location relative to the actual rest position of the movable element;

the provision of such a system which is effective with sensors monitoring very tight tolerances for acceptable movement of one object relative to another;

the provision of such a system in which a first window is rapidly movable before system set-up, but moves extremely slowly thereafter to compensate only for long term changes such as environmental changes or seasonal changes which effect the temperature and humidity to which the objects and system are subjected;

the provision of such analog position sensors having a dual sensing range with a first and narrower sensing range being used for setup, and a second and wider sensing range being used for normal monitoring;

the provision of such analog position sensors which can be either used as original equipment in new security systems or retrofitted into existing systems; and, the provision of such a security system having an enhanced monitoring capability and which provides users the absolute highest level of assurance possible that their premises are adequately protected.

In accordance with the invention, generally stated, in a security system monitoring the relative movement of one object to another object (a door to a door frame, for example), a method is provided for establishing a window encompassing a range of acceptable motion which the one object may have with respect to the other object without putting the system into an alarm condition thereby to create a balanced sensor arrangement. An analog signal is created at one of the objects and this signal is monitored at the other objects. A least one characteristic of the signal provides an indication as to the relative position of the objects, and a nominal signal characteristic value represents a nominal position of the one object relative to the other object for a predetermined set of conditions. Set about this nominal value, on at least one side of the value is a range of signal characteristic values representing a range of acceptable motion through which the one object may move relative to the other object without putting the system into an alarm condition. The total range of signal characteristic values representing the acceptable range of motion defines a window. The size of the window is maintained so long as the one object moves relative to the other object within the window. But, in response to movement of the one object relative to the other object outside the window, such movement putting the system into alarm, the size of the window is changed. The range of acceptable motion now defined by the window is a second range different from the first said range. The window retains this second range until the one object moves to a position within the second range of acceptable motion so to take said system out of alarm. Other objects and features will be in part apparent and in part pointed out hereinafter.

BRIEF DESCRIPTION OF THE SEVERAL VIEWS OF THE DRAWINGS

In the several figures of the drawings, like reference numerals designate like components, and in those drawings.

Corresponding reference characters indicate corresponding parts throughout the drawings.

DETAILED DESCRIPTION OF THE INVENTION

Figure 1:
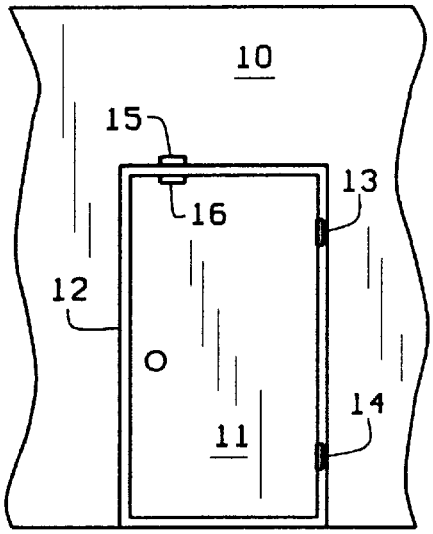
FIG. 1 is a simplified illustration of a door and door frame for use in understanding the invention.

Referring to the drawings, in FIG. 1 a portion of a building 10 is shown in which a door 11 is installed. The door is installed with a door frame 12 and the door is attached to its frame by a pair of hinges 13, 14. A reed switch 15 is attached to the door frame, and a magnet 16 is affixed to the door. When the door is closed, the magnetic field produced by magnet 16 holds reed switch 15 in a closed position. However, when door 11 is opened, the magnet is moved away from the reed switch, and the strength of the magnetic field in the area of the reed switch decreases. When this occurs, reed switch 15 opens to signal the door-open condition. While not shown, it will be understood that a similar arrangement also works for a window with the reed switch being attached to the window frame and the magnet to the movable portion of the window. The reed switch/magnet combination is a conventional setup for indicating door or window opening in previous security systems.

Figure 2B:
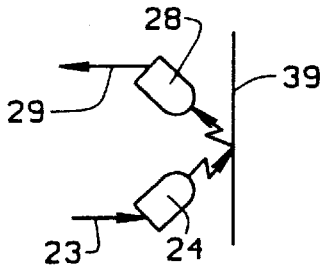
FIG. 2B is a partial block diagram showing a modification to the security system of FIG. 2A.
Figure 2A:
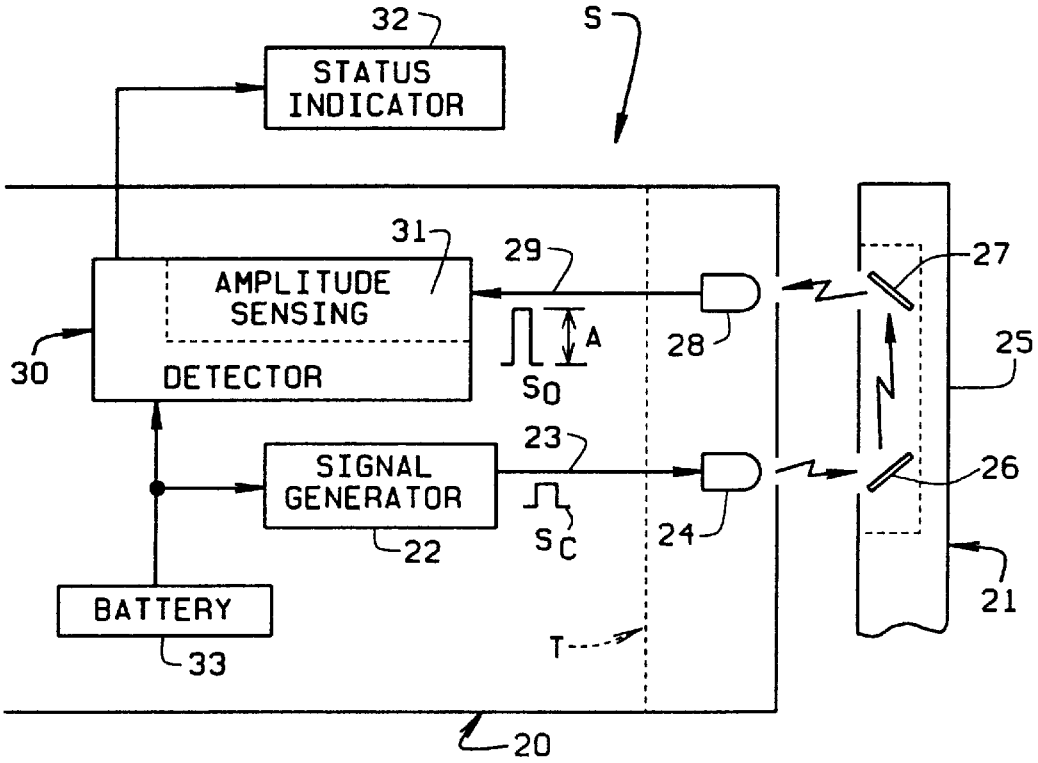
FIG. 2A is a simplified block diagram of a first embodiment of a security system of the present invention.

FIG. 2A illustrates part of a security system S constructed in accordance with the present invention. Among its many features, security system S indicates the displacement between a first (reference) unit 20, which is preferably mounted on a door frame or window frame, and a second unit 21 which is positioned adjacent unit 20. The second unit may be attached to a door, the movable portion of a window, or some other element by which the second unit is movable with respect to the first unit. It will be understood that the first and second units may both be movable, so there is relative movement between the two units then when either is moved from one position to another. Included in first unit 20 is a signal generator 22 which is coupled over a line 23 to a first transducer 24 of a transducer means T. Transducer 24, in the preferred embodiment, is a light source; for example, an infra-red light-emitting diode (LED) which generates a transmission signal (infra-red light) when energized by a command signal Sc from signal generator 22. A reflector 25 is included in second unit 21 and includes first and second mirrors 26, 27 which are installed in unit 21 so light from a predetermined direction (as indicated by the wavy arrow in FIG. 2A) impinging upon one of the mirrors is directed at the other mirror. The mirrors are oriented in FIG. 2A so that light impinging upon mirror 26 is reflected at a 90° angle toward mirror 27, and light impinging upon mirror 27 is also reflected at a 90° angle. It will be understood that depending upon a particular installation, these angles could be changed.

A second transducer 28 of transducer means T is, for example, a light receiver such as an infra-red sensor unit, and is included in reference unit 20 to receive signals transmitted by transducer 24. When signal generator 22 energizes first transducer 24, the transducer emits an infrared signal which is directed at mirror 26 of reflector 25. A portion of this transmitted signal is reflected by mirror 26 toward mirror 27 and (as shown by the other wavy arrow in FIG. 2A) back toward second transducer 28. This transmission and reception of infrared energy will only occur if second unit 21 is in a predetermined reference position (as shown in FIG. 2A) adjacent first unit 20. A detector 30 included in unit 20 detects an output signal So generated by transducer 28 over line 29 in response to receipt of a reflected transmission from transducer 24. It will be understood that unit 20 may comprise a single housing or enclosure or that the components may be housed in multiple enclosures.

Detector 30 includes amplitude detection circuitry 31. The amplitude A of the signal So generated by transducer 28 is a function of the amount of energy received by the transducer. If unit 21 is in its predetermined position as shown in FIG. 2A, the amount of energy received by transducer 28 is a maximum and the amplitude of the signal generated by the transducer is a peak value. As the door or window is moved, so second unit 21 is moved away from its reference position, the amount of energy received by transducer 28 is reduced. The amplitude of the resulting signal generated by second transducer 28 is correspondingly less than the peak value. Amplitude detection circuitry 31 senses the amplitude level of the output signal So from the transducer and compares this level with a predetermined threshold value. When the output signal amplitude is within an acceptable range of values, detector 30 provides an appropriate output to a status indicator 32 of the security system. If the signal amplitude falls outside this range, detector 30 provides an appropriate output of this condition to status indicator 32 as well. Finally, it will be understood that while second unit 21 is a passive unit, first unit 20 requires a source of power such as is supplied by a battery 33 to both signal generator 22 and detector 30.

In FIG. 2B, a modification of the arrangement of FIG. 2A is shown. Here, reflector 25 with its canted mirrors 26, 27, is replaced by a single, flat plate mirror 39. Now, transducers 24 and 28 are each aligned at 45° angles with respect to this mirror so that the infrared light waves emitted by transducer 24 are reflected off mirror 39 directly at transducer receiver 28 through the resulting 90° angle. While this embodiment replaces the two mirror arrangement with a single mirror, it will be understood that other mirror arrangements can be used without departing from the scope of the invention. For example, instead of a flat plate, mirror 39 can be a convex mirror with the alignment of the transducers being the same as that shown in FIG. 2A. Again, it will be understood that depending upon a particular installation, these angles could be changed. It will be noted that adjusting the angles can be used to set the distance between the objects.

Figures 3, 4:
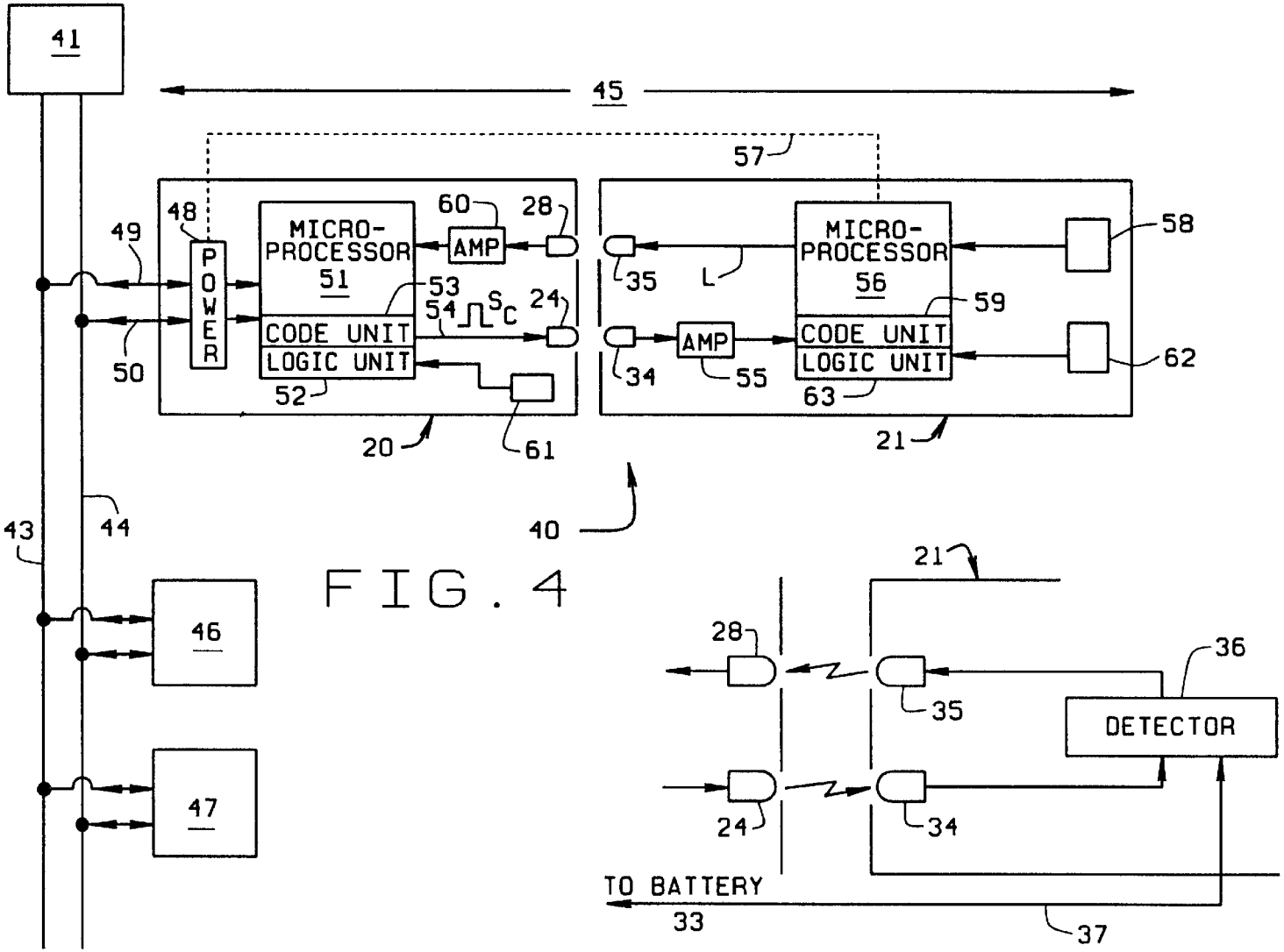
FIG. 3 is another partial block diagram showing another modification to the security system.
FIG. 4 is a block diagram of a preferred embodiment of the security system of the invention.

In FIG. 3, another embodiment of the security system involves replacement of reflector 25 by another pair of transducers 34, 35. Transducer 34 comprises an infrared receiver which detects the infrared light emitted by transducer 24 in response to a command signal from generator 22. The output of transducer 34 is provided to a detector/generator 36 which may also be connected to a power source through a power line 37; or which, may have its own independent power source such as a battery (not shown). Detector 36, in response to receipt of an input from transducer 34, generates a signal which is supplied to transducer 35; which, like transducer 24, is an infrared LED. The infrared light emitted by transducer 35 is now received by transducer 28 which responds thereto by generating an output signal So as before.

With respect to the features of security system S, as shown and described in FIGS. 2A, 2B, and 3, it is important to understand that, in addition to being able to provide a status indication as to whether a door or window is open or closed, the system is also difficult to trick. Whereas with reed switches and magnets, it may have been possible to fool the security system using other magnets into thinking a door or window was closed when it was actually open, use of the infrared optical sensors incorporated in units 20, 21 cannot be readily decoyed into providing an incorrect status indication. Signal generator 22, for example, can provide a complex code of command signals to transducer 24. The signal generator can vary the signal scheme so the same light emission pattern produced by the transducer at one instant is not the same as that produced at another instant. In the embodiment of FIG. 3, use of the detector/generator 36 adds an additional complicating element for one trying to fool the system This is because the signal pattern commanded by detector 36 of transducer 35 does not have to be the same pattern commanded by generator 22, produced by transducer 24, received by transducer 34, and processed by detector 36. Thus someone trying to defeat the security system will have to try to uncover the coding scheme of at least one, and possibly two, different signal generators; in addition to providing signals of the correct amplitudes. And, these coding schemes can be variable over time, and not a function of one another.

Referring to FIG. 4, a preferred embodiment of the invention includes a security system indicated generally 40. A pair of conductors 43, 44 provide a path for electrical signals and power from a central controller 41 to a plurality of security locations or points 45, 46, 47. Point 45 represents, for example, a door/door frame combination such as previously described. At this location, a first unit 20 is mounted or attached to the fixed part of the assembly (the door frame), and a second unit 21 is attached to the movable portion of the assembly (the door).

Unit 20 includes a power supply 48 which is connected to conductors 43, 44 via conductors 49, 50. Or, the power supply can be a battery which does not need connection to the conductors but rather independently supplies power to unit 20. Unit 20 includes a microprocessor 51 which includes a logic unit 52 and a code unit 53. The output of the microprocessor is a command signal Sc sent over a line 54 to transducer 24. Transducer 24 generates infrared light signals as previously discussed, which are coded in a predetermined manner as determined by code unit 53 of microprocessor 51 for the purposes also previously discussed. These infrared light transmissions are received by transducer 34 located in unit 21. The output signal from transducer 36 is supplied through a signal amplifier 55 to a microprocessor 56 in unit 21. This second microprocessor is either powered by power supply 48 via the dashed line connection 57 shown in FIG. 4, or the microprocessor is separately powered by a battery 58. If powered from power supply 48, the electrical wires are run through the door frame near a hinge since this comprises the minimum distance between the door and door frame.

The amplified signal from transducer 34 is received and processed by microprocessor 56. This microprocessor includes a code unit 59 which now evaluates this signal to determine if the received coded input to the microprocessor matches that transmitted by microprocessor 51 through transducer 24. If it does, then code unit 59 generates a coded response signal which is supplied by microprocessor 56, through a line L, to transducer 35 which emits an infrared signal from unit 21 toward transducer 28 in unit 20. The signal received by transducer 28 is amplified by an amplifier 60 and provided as an input to microprocessor 51. The microprocessor uses its code unit 53 to ascertain if the received, coded response from unit 21 is the correct response.

At both microprocessor 56 (for the transmitted coded signal) and microprocessor 51 (for the return response), the received signals are processed with respect to both the content (i.e., coding) of the signal, and the signal amplitude. There are five conditions which are monitored. Of these, four may produce a possible alarm condition resulting in an alarm signal being sent from unit 20 over conductors 43, 44 to central controller 41. Transmission of alarm signals is as taught in U.S. Pat. Nos. 4,394,655; 4,470,047 and 4,507,652, the teachings of which are incorporated herein by reference. The only condition which will not trigger an alarm is one in which the both the contents of the signal are correct, and the signal amplitude falls within a predetermined range of acceptable values. With respect to the other possible conditions, if the signal amplitude is too great (above the range) then the signal has possibly been generated by a substitute unit in order to trick the security system. If the signal is too weak, it signifies the door or window has been opened. If there is no signal, it indicates the door is substantially open or possible trouble within the system. If the signal data is incorrect, it signifies that again someone is trying to trick the system.

Figure 5:
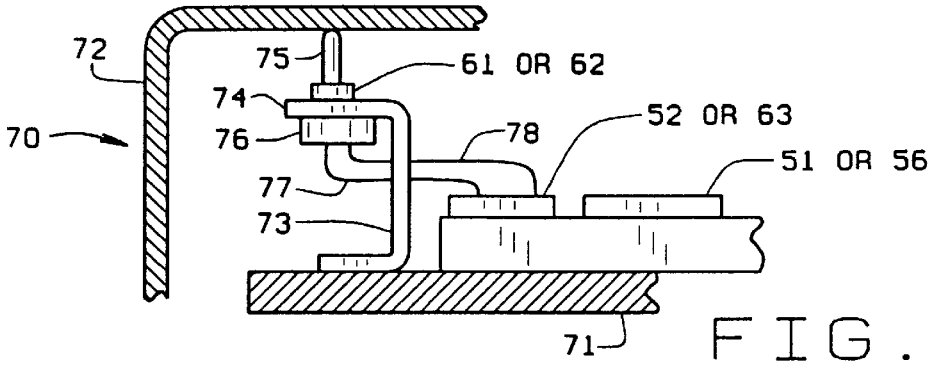
FIG. 5 is a partial, broken-away view illustrating the placement and operation of a tamper switch of the security system.
Figure 6:
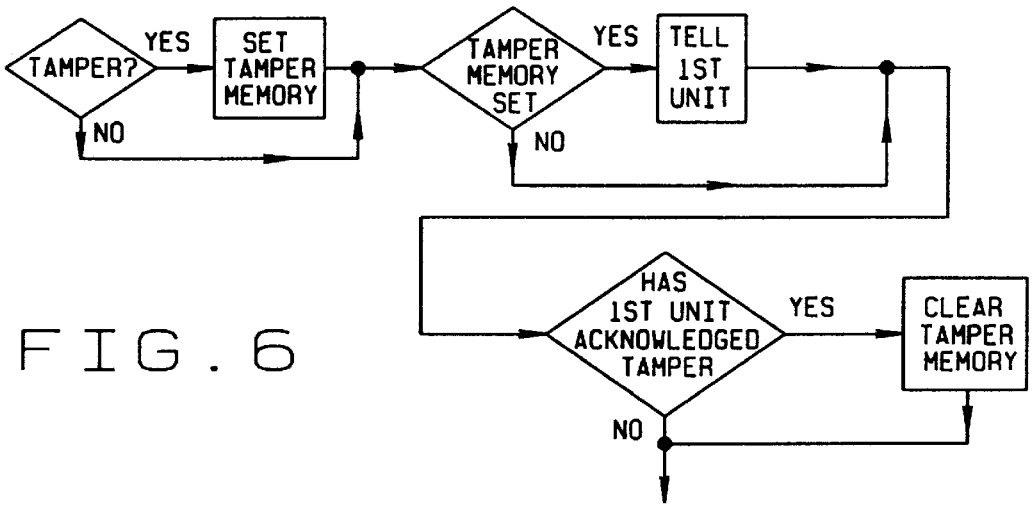
FIG. 6 is a flow chart useful in understanding operation of the tamper switch.

A tamper switch 61 is connected in unit 20, and another tamper switch 62 is connected in unit 21. Switch 61 connects to logic unit 52 of microprocessor 51, and switch 62 to a logic unit 63 of microprocessor 56. The tamper switches are identical in construction and one of the switches is shown in more detail in FIG. 5. The tamper switch provides an output electrical signal in response to a mechanical displacement. Each unit 20 and 21 is housed in an enclosure 70 having a base 71 and cover 72. A bracket 73 is mounted to the base 71 of each enclosure. The bracket has a bracket arm 74 in which the tamper switch is installed. A spring loaded plunger 75 of the switch extends upwardly from a switch housing 76, and the plunger is depressed when cover 72 is fitted over the base enclosing the elements of the respective units. Electrical connection is made between the switch and the respective logic unit of the microprocessors by conductors 77, 78. After installation of the respective units, removal of the cover of either unit will cause switch 61 or 62 to produce an electrical output signal to the associated logic unit of the respective microprocessor. The generation of this signal does not necessarily trigger an alarm, just as the occurrence of one of the four conditions described above does not necessarily trigger an alarm. Rather, microprocessors 51 and 56 are programmed to store all occurrences in their memory, whether they are one of the four anomalous conditions or the triggering of the tamper switch. Central controller 41 periodically polls each of the points on a loop including points 45, 46, and 47. Whenever microprocessor 51 receives a poll, it communicates to the central controller that information representing what has occurred since the last poll. As shown in the simplified flow chart of FIG. 6, if there is a tamper, a tamper memory incorporated in each microprocessor records this event (i.e., the memory is set). Regardless of whether there is a tamper, when a microprocessor is polled by central controller 41, it communicates to the controller if there has been a tamper or has not been a tamper. If there has been a tamper, the controller acknowledges the event and then memory is cleared.

Units 20, 21 of security system 40, and their associated processing circuitry, provide a multiple "window" capability which allows for set-up of the system in a stable operating condition, the re-establishment of that stability after the system goes into alarm, and the ability to adjust for seasonal changes which may effect the system. In this latter regard, it will be understood that although a range of acceptable movement of a door relative to a door frame, for example, is a fixed value, the actual physical size of the door or frame may change over time due to seasonal temperature and humidity variations. Such changes can result in false alarms. The method of the present invention accommodates for these changes as well for system set-up requirements and the need to establish stable operating conditions in the event of an alarm so the system does not unnecessarily keep going into alarm.

Referring to FIGS. 9A–9G, unit 20 is shown mounted on door frame 12 (a fixed object), and unit 21 on door 11 (a movable object). In opening and closing the door one object moves relative to the other. In a monitoring situation, door 11 may be allowed to only move a certain amount. If the door is moved beyond that distance, the security system goes into alarm. It will be understood that the distance of allowable movement may be a stipulated distance from some nominal position (i.e., ±¼"). As previously described, a signal is transmitted between units 20 and 21, and this signal can be processed as an analog signal Sa having one or more characteristics representing the distance of separation between the units. Those skilled in the art will appreciate that while an infrared signaling system is described with reference to units 20, 21, other elements can be used to generate, in effect, an analog signal. For example, a Hall effect device and associated magnet can be used, with the strength of the magnetic field being sensed instead of the intensity of an optical path. Regardless of the sensing device used, the resulting output is the signal Sa shown in FIGS. 9A–9G.

Figure 7:
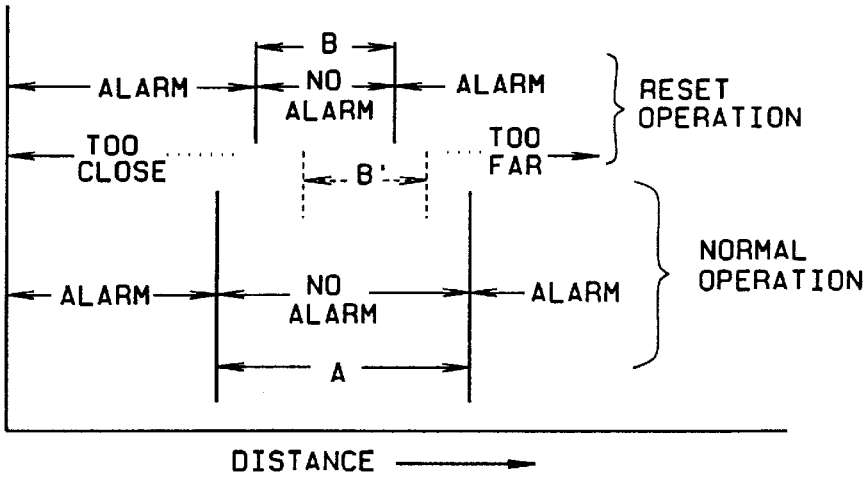
FIG. 7 illustrates respective operational ranges of optical sensors employed in the security system to prevent false alarms.

Referring to FIG. 7, security system 10 and units 20, 21 incorporate a "hysteresis" feature to prevent intermittent false alarms when units 20, 21 are moved small distances with respect to each other. Under normal conditions, an alarm threshold is established for a predetermined distance of separation. This is the distance A shown in FIG. 7. Note that there is an alarm given if the distance between door 11 and door frame 12, for example, is either too close, and too far. Those skilled in the art will appreciate that "too close" although not necessary, adds an additional level of security. The normal distance of separation between units 20, 21 when door 11 is closed is a distance that falls within the range A, and for this situation no alarm is given. This distance is, for example, ½". In accordance with the invention, whenever an alarm condition exists, the software incorporated in the security system adjusts the alarm threshold to a narrower range indicated B in FIG. 7. This range is, for example, ¼". A predetermined delay is incorporated in the system to stabilize its operation; this delay being, for example, approximately three seconds. If the system determines that the units 20, 21 remain in the narrow no-alarm range B for the predetermined delay period, then the alarm threshold is automatically expanded to the wider no-alarm band A. The delay period ensures that if the door bounces when first closed, the security system will not set up as normal unless door 11 and frame 12 spacing remain within range B until the expiration of the delay period. The use of this dual range feature provides a certain margin for error (i.e., door movement) without an alarm resulting. This prevents the issuance of false alarms, because the door must be closed to within the narrow range B before the system will set up as normal. At door closing time, the door must be positioned within the narrow no-alarm range B, and not in a position on the verge of an alarm condition. Note that while both range A and range B are centered about the same distance of separation, this does not have to necessarily be so. Rather, range B can be skewed to one side of range A or the other as indicated by B' in FIG. 7.

Figure 8:
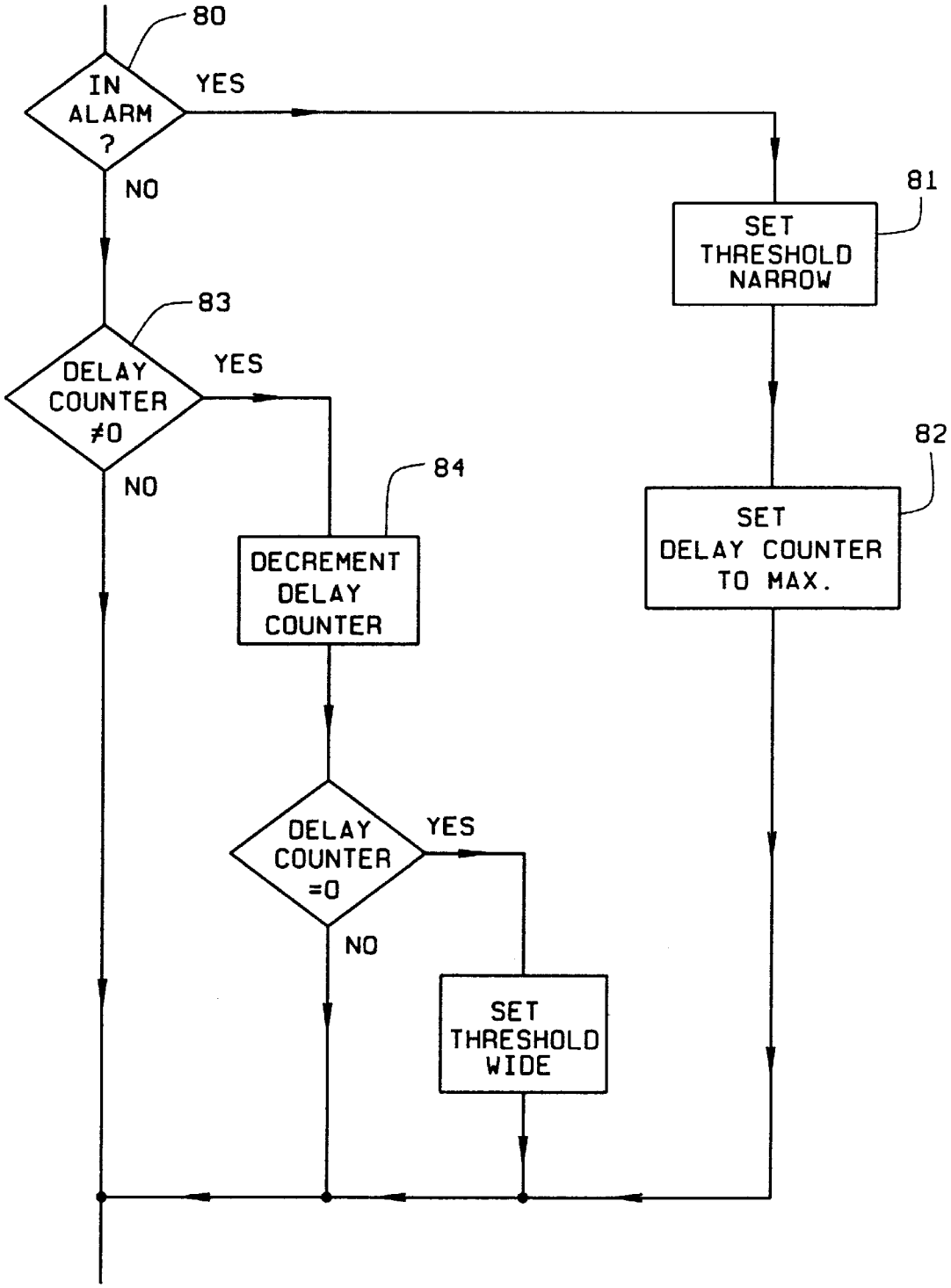
FIG. 8 is a flow chart illustrating how the security system alarm threshold is adjustable to prevent false alarms.

FIG. 8 represents a flow diagram for the operational sequence described with respect to FIG. 7. If the system is in alarm as indicated at 80, then the alarm threshold is set at the narrower threshold of range B as indicated at 81. In addition, a delay counter (not shown) is set for the full delay period as indicated at 82. If the system is not in alarm, the status of the delay counter is checked as indicated at 83. If the delay count value is zero, then the wider range A may pertain dependent upon the delay counter value. The counter is now decremented as indicated at 84. At 85, the status of the delay counter is again checked. If it is not at zero, then the narrower range B remains in effect. However, as indicated at 86, if the counter value has reached zero, and if the units are still within range B, then the range is expanded to range A.

Figure 9A:
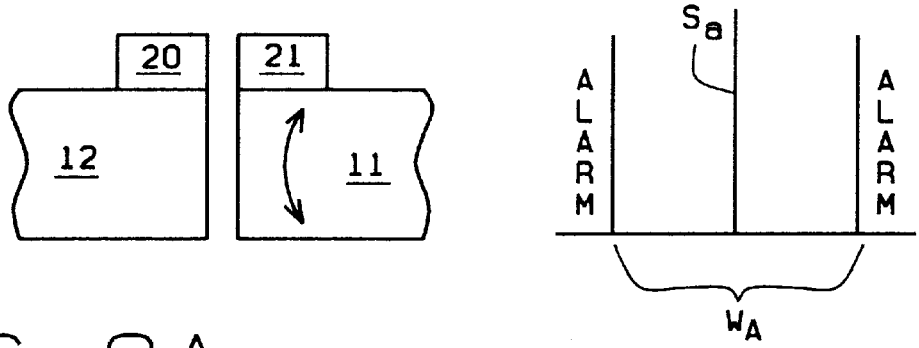
FIGS. 9A–9G illustrate the set-up of the system, and the effect of sensor movement on an active window; and, FIG. 10 is a schematic circuit diagram for a circuit used in implementing the movable windows.

Further understanding of the movable windows concept of the present invention is illustrated in FIGS. 9A–9G. In FIG. 9A, door 11 is shown as being closed, which is the monitored position of the door. During set-up of the security system, the installer positions unit 20, 21, as shown. However, unlike previous system installations in which the installer had to move one sensor relative to the other to ascertain the limits of acceptable movement before the system went into alarm, and then position the sensors to achieve a "balanced" situation; now, the installer can install units 20, 21 without having to go through this process. Rather, the balance for the sensors is automatically achieved such as by the circuit shown in FIG. 10 and described hereinafter. In the diagram accompanying FIG. 9A, the line Sa represents a signal value corresponding to the position of the door and door frame. The vertical lines on either side of line Sa represent the edges or boundaries of a window Wa whose width corresponds to the range A in FIG. 7. As shown in FIG. 9A, signal Sa is centered within the limits of window Wa. After set-up, and when the security system is stable; i.e., not in alarm, window Wa is active and the window Wb corresponding to the range B shown in FIG. 7 is inactive. This is the system status indicated in FIG. 9A.

Figure 9B:
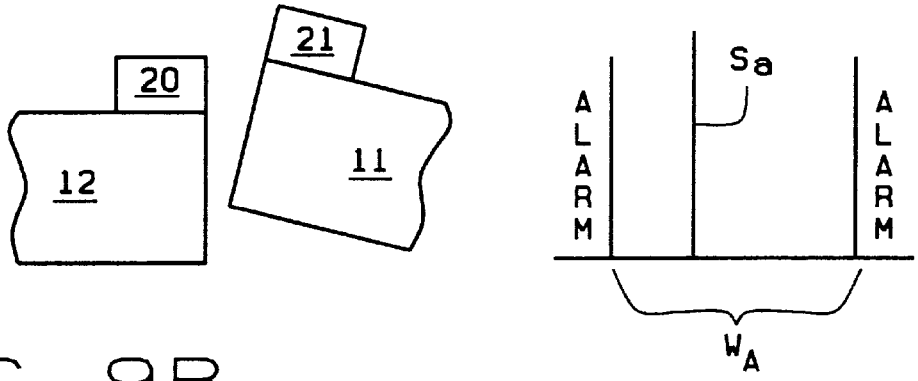

In FIG. 9B, door 11 is shown as being partially opened in one direction with respect to the frame. Signal Sa is now shown as being to one side of its centered position value, but still within the boundary limits established by window Wa. For this situation, the security system is not in alarm, so window Wa remains the active window.

Figure 9C:
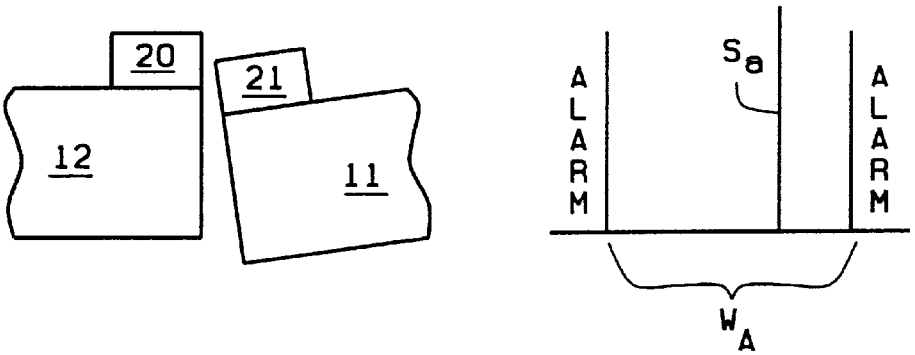

In FIG. 9C, door 11 is shown as having moved in the opposite direction with respect to the frame. Now, signal Sa is shown as having shifted toward the other boundary limit of window Wa, but still within the range of acceptable movement established by the window. For this condition, the system is also not in alarm. It will be noted with respect to FIGS. 9B and 9C, that the degree of door opening movement is, in each instance, very slight. That is, in neither instance is the door clear of the frame, meaning that someone cannot readily pass through the door without detection.

Figure 9D:
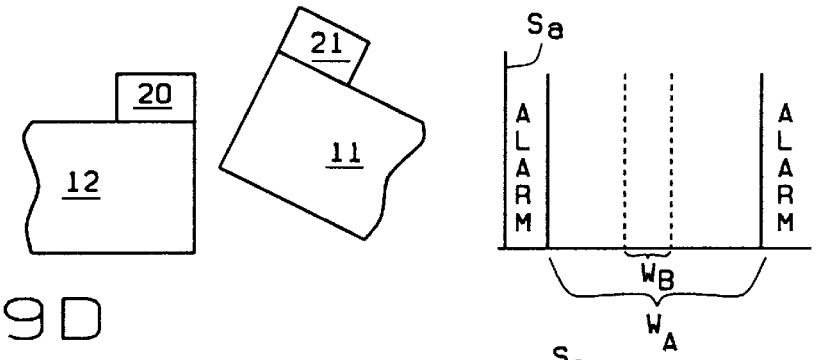

In FIG. 9D, door 11 has been opened to the point where the value of signal Sa has moved outside the limits of window Wa. Because signal Sa is now outside the window limits, the security system is now in alarm. In addition, as soon as the system goes into alarm, window Wa is supplanted by the narrower range window Wb as indicated by the dashed lines in FIG. 9D. That is, window Wb is now active, and window Wa inactive.

Figure 9E:
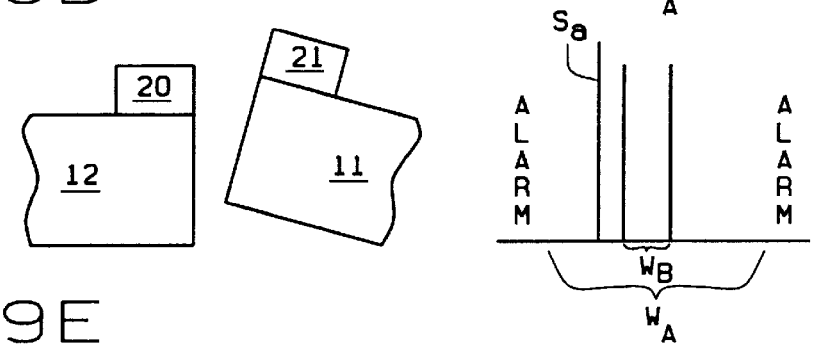

In FIG. 9E, the position of door 11 has been moved back to substantially the same position as was shown in FIG. 9B. However, because the active window is the narrower range window Wb, the security system remains in alarm. Had the system not gone into alarm, window Wa would be the active window and the door position shown in FIG. 9E would not put, or keep, the system in alarm.

Figure 9F:
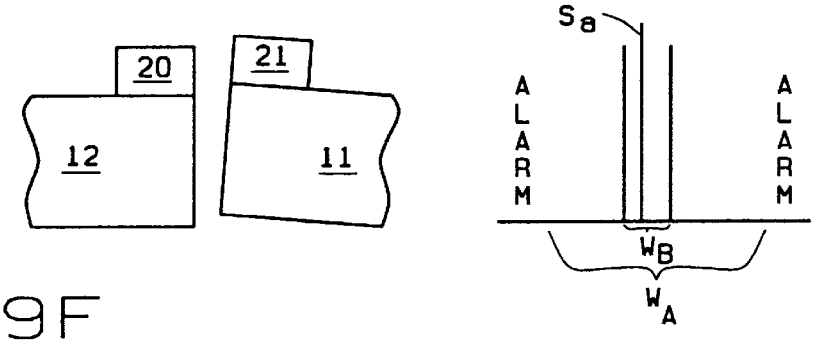

In FIG. 9F, the door has been closed further than its position of FIG. 9E. Now, signal Sa is within the narrow range window Wb. For this position, the system has now gone out of alarm. However, narrow range window Wb is not at this time deactivated, and wider range window Wa remains inactive. Now even though the door is closed to within the acceptable range, window Wb is retained for a predetermined period of time until the system stabilizes. That is, door 11 is not stationary; or if moving, moving only a very small distance in either direction. Finally, at the end of the period, window Wa is reactivated, window Wb is deactivated, and the system returns to its condition shown in FIG. 9A.

Window Wa is also responsive to seasonal or climatic changes which may effect the relationship of the door and window and the range of relative movement which may occur before the system goes into alarm. It is well understood that certain materials expand during hot weather and contract during cold weather. The amount of humidity in the air also can cause dimensional changes. In some instances, these changes are negligible. In others, particularly where limits of movement are tight, the security system may go into alarm when an actual alarm condition does not exist because of the environmentally produced changes in dimensions. Window Wa also prevents this from happening. Window Wa is responsive to seasonal and climatic changes, which are generally very slow changes and which take place over long periods of time. Window Wa tracks these changes so the relative limits of the windows can be adjusted accordingly.

Figure 10:
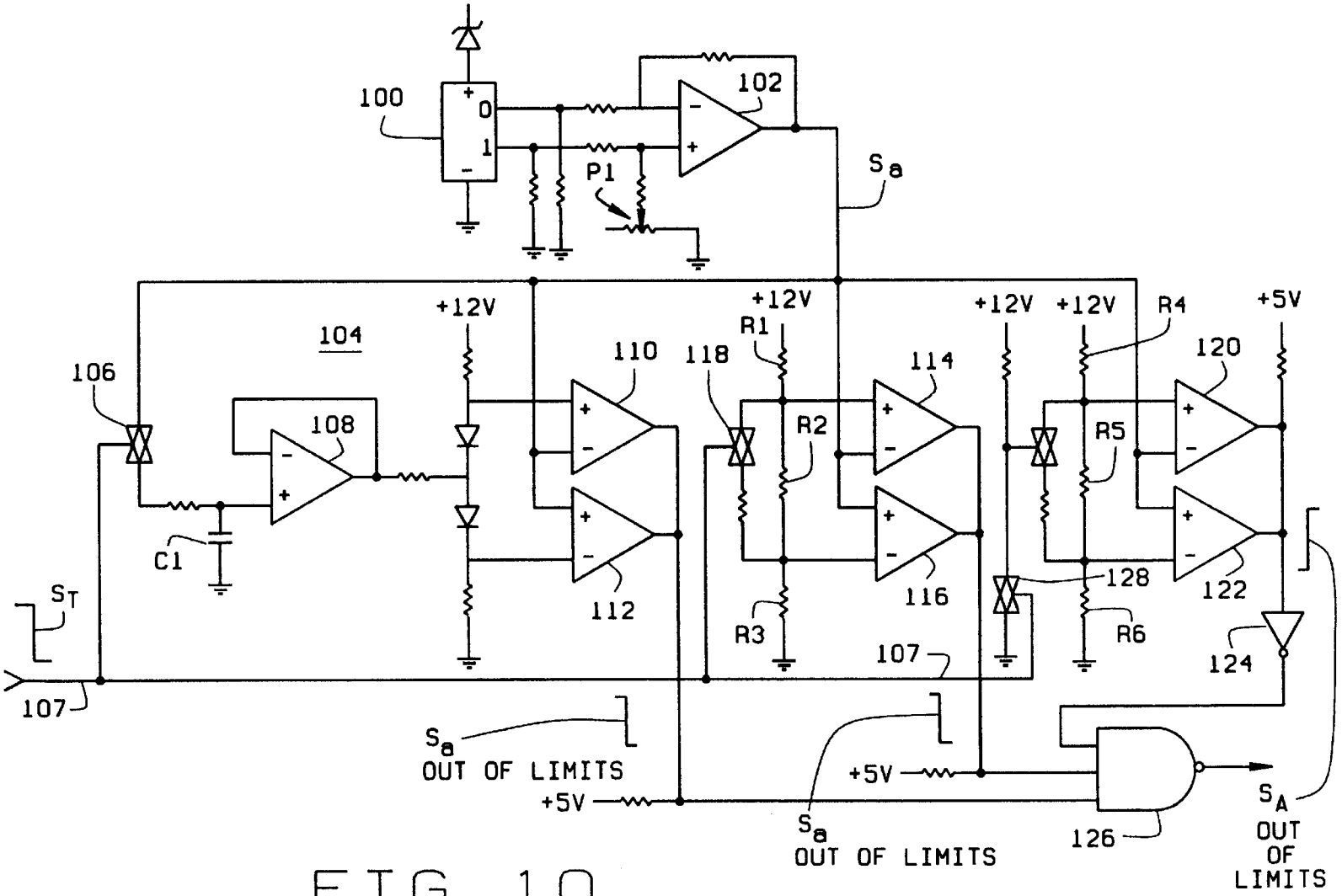

Referring to FIG. 10, a Hall Effect sensor 100 has two differential linear outputs which are opposites of each other, i.e., when one goes positive—the other goes negative. These outputs are each supplied to a differential amplifier 102 which has a gain of, for example, approximately three and one half. The output of amplifier 102 is the sensor signal Sa which has a nominal value of 6.0 volts (as set by use of a potentiometer P1), when no magnetic field is being sensed by the Hall Effect sensor. When Hall Effect sensor 100 senses a magnetic field from the North pole of a magnet, the output of amplifier 102 becomes more positive. Conversely, when the Hall Effect sensor senses a magnetic field from the South pole of a magnet, the output of the amplifier becomes less positive. The output from amplifier 102 is compared against various signal levels to determine whether a normal or alarm condition exists. The distance between sensor 100 and a magnet, the polarity of the magnet, the position of the magnet, etc., all cause a change in the output of sensor 100. In any given installation, the sensor signal is relatively stable, but its value is unknown. Further, the sensor signal is also supplied as an input to a moving window portion 104 of the circuit.

The moving window portion of the circuit compensates for the above noted variations. With reference to the discussions of FIG. 7 and 9A–9G, the size of the window is, for example, fixed at approximately 1.2 volts. When a magnet and sensor 100 are set approximately ½ inch apart, there is an operating gap of approximately ±⅛ inch; that is, the magnet may move ⅛ inch closer to, or ⅛ inch farther from, sensor 100 without the security system going into alarm. Further, the magnet always appears to be positioned in the center of this range because of a tracking feature of the moving window circuit. For example, if the magnet is attached to door 11, and the door is closed as shown in FIG. 9A, a track enable signal St will allow the window Wa to center itself about the sensor signal Sa by enabling a track analog switch 106. Signal St is supplied to switch 106 over a line 107. The signal is a logic low for normal security system operation, but a logic high during set-up of the window. With switch 106 enabled, a capacitor C1 will track the voltage level of sensor signal Sa. Once window Wa has stabilized, the track enable signal is shut off, and the moving window becomes fixed. The magnetic field is now centered in window Wa at this time. As previously described, movement outside the window will cause the system to go into alarm.

The output of an amplifier 108 follows the charge stored by capacitor Cl and establishes upper and lower alarm limits for the window. That is, the upper limit on the moving window is now at a value 0.6 volts above the sensor signal value, and the lower window limit is a value 0.6 volts below the sensor signal value. Differential comparators 110 and 112 provide an alarm output signal (a logic low) if the value of sensor signal Sa exceeds either of the limit values. By identifying when the sensor signal value goes outside the established moving window limits, these comparators form an alarm detection circuit.

A fixed resistor voltage divider network comprising resistors R1–R3, in conjunction with differential comparators 114, 116, establishes a maximum window of operation. One limit on this maximum window is the maximum allowable field strength from the North pole of a magnet. Above this point the amplifier circuits go into saturation. The other limit established is the maximum allowable field strength from the South pole of a magnet. Below this point the amplifier circuits go into cutoff. Differential comparators 114, 116 output a greater than maximum value (>max.) alarm signal (a logic low) if the value of sensor signal Sa moves outside the limits of this maximum window.

While setting up moving window Wa, it is not desirable to allow a set point where the moving window includes either of the upper or lower limit values as determined by the voltage divider network. To prevent this situation, an analog switch 118 is enabled while the moving window Wa is tracking. Enabling this switch modifies the voltage divider network so to tighten the upper and lower limits of the window. That is, these values are each moved approximately 0.7 volts toward each other. Knowing that the moving window Wa is 0.6 volts higher and lower than the midrange value of sensor signal Sa ensures that the window limits have not been set so that an alarm condition exists within the established limits of the window.

A second fixed resistor voltage divider network comprising resistors R4–R6 establishes the second window Wb of operation, this second window having narrower limits than window Wa as previously described. One limit on this second window is now the minimum field strength from the North pole of a magnet. Below this point would be a demagnetized magnet, or a magnet too far away from the sensor. The other limit is now the minimum field strength from the South pole of a magnet. Above this point is a demagnetized magnet; or again, a magnet too far from the sensor. Differential comparators 120, 122 output a less than minimum (<min) alarm signal (a logic high) if sensor signal Sa ever moves outside the established window Wb limits. This signal is inverted from a logic high to a logic low signal by an inverter 124. The output signal from the inverter is provided as one input to a NAND gate 126 where it is ANDed with the outputs of the two other window comparator circuits. If the three inputs to gate 126 are all a logic low, the gate generates a logic high output which represents an alarm indication.

When establishing the moving window, it is again not desirable for either limit of the window range to include the upper or lower values established by the second voltage divider circuit. To prevent this occurrence, an analog switch 128 is disabled while the moving window is tracking. Disabling switch 128 modifies the resistor divider network to expand the minimum window with the respective upper and lower limit values each being moved approximately 0.7 volts away from each other. Since the limits on window Wa are 0.6 volts higher and lower than the midrange value of signal Sa, expanding the minimum window ensures that the window has not been set so as to create a minimum alarm within the window.

It will be understood that the above described circuitry may be incorporated in microprocessor 51. Whenever an alarm signal is generated at gate 126, the central alarm station 41 is notified. In return, the central alarm station transmits a Clear Alarm Latch command back to the unit. This response is latched in the above described control circuit over line 107 and is identified as a SET condition. The circuit now remains in this state until the microprocessor is polled without the Clear Alarm Latch command. As previously noted, with a SET condition, the track enable signal on line 107 is a logic high. In this condition, window Wb now tracks the sensor signal Sa. Window Wb, in effect, represents window Wa with the maximum flux portion of window Wa tightened, and the minimum flux portion expanded. When sensor signal Sa again is within the now acceptable range limits of window Wb, the alarm output of gate 126 goes low, taking the system out of alarm. However, window Wb still continues to center itself on sensor signal Sa.

Figure 9G:
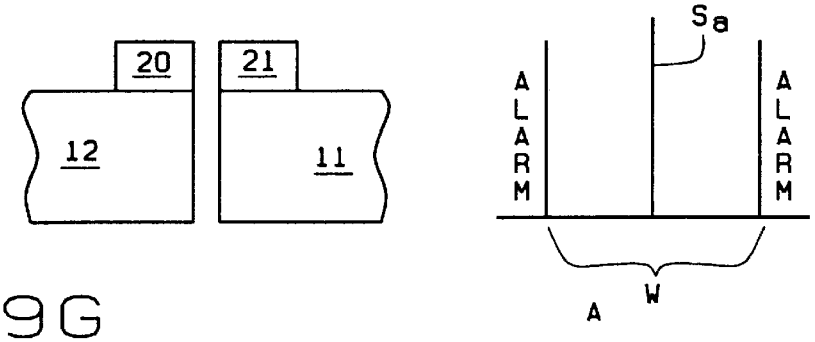

When central alarm station 41 identifies that the circuit is responding with a normal response, it stops sending the Clear Alarm Latch command over line 107. Now, the control logic changes state from SET to NORMAL; i.e., the signal on the line goes to a logic low. The window no longer tracks sensor signal Sa, maximum flux expands back to its normal limits, and minimum flux tightens back to its normal limits. That is, window Wb switches back to window Wa as indicated in FIG. 9G. If signal Sa again moves outside the limits of window Wa, the circuitry again indicates an alarm condition via gate 126.

Finally, to compensate for environmental changes such as temperature, or other minor variation in signal Sa, microprocessor 51 periodically pulses the track enable signal from low to high for a short duration (1–2 msec., for example). The duty cycle of this pulse is approximately 1%, and this allows the window Wa to track very slow changes in the sensor signal. This enables the circuit to respond to the small variations in the signal that occur, for example, over a period of from 15 minutes to 1 hour.

What has been described is a security system and sensing element which overcomes shortcomings of prior art security systems which depend on magnetic fields and their disruption or change to indicate an alarm condition. By using a transmission signal in the range of light, such as the output of a light-emitting-diode in the infra-red range, the system cannot be compromised by a magnet or other unit which produces and/or varies a magnetic field. The security system of the present invention uses a first unit mounted in a relatively fixed position such as a door frame or window frame, and a second unit mounted to the movable element; i.e., the door or window. Coded data is transmitted back and forth between the two active circuits in a restricted transmission path, such that varying the physical proximity of the two circuits interrupts or modifies the transmission path with the system identifying such interruption or modification as an alarm condition. By using a complex algorithm, for example, the type now used by financial institutions to verify communications in funds' transmission, security of the system of the invention is virtually assured. The transmitted data must be appropriate so that, when modified, the correct response is received to indicate proper position of the responding unit. The output provided by the microprocessors and code units is a special data set known to the code module in the microprocessor of both units. These data sets are the result of encryption algorithms known to be especially difficult for units, other than these two specific code units, to decode. The movable unit can be powered from a battery internal to the unit, or from energy received over the system conductors which carry information between the various security points and the system controller, or from some other source.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

I claim:

1. In a system monitoring the movement of one object relative to another object, a method of establishing a window encompassing a range of acceptable motion the one object may have with respect to the other object without putting the system into an alarm condition comprising:

creating, at one of the objects, a signal monitored at the other of the objects with at least one characteristic of the signal providing an indication of the position of the one object relative to the other object; and, establishing a range of signal characteristic values representing a range of acceptable motion through which said one object may move from said nominal position relative to the other object, said range of acceptable motion defining the size of said window.

2. The method of claim 1 further including maintaining the size of said window so long as said one object moves relative to said other object within said range of acceptable motion, but varying the size of the window in response to the movement of the one object relative to the other object outside said range of acceptable motion, such movement putting said system into alarm, the range of acceptable motion now defined by said window being a second range different from the first said range of acceptable motion, said window maintaining said second range of acceptable motion until said one object moves to a position within the second range of acceptable motion now defined by said window.

3. The method of claim 2 wherein said signal is an analog signal.

4. The method of claim 3 wherein said characteristic of said analog signal is the intensity of a magnetic field.

5. The method of claim 2 wherein said characteristic of said analog signal is the intensity of an optical signal.

6. The method of claim 3 wherein the value of said analog signal is measured against values representing said second range of acceptable motion when said one object is first moved into a position relative to the other of said objects, and thereafter against values representing said first range of acceptable motion.

7. The method of claim 6 wherein said analog signal is measured against values representing said second range of acceptable motion for a predetermined period of time before being measured against said first range of acceptable motion thereby to allow said system to stabilize.

8. The method of claim 7 wherein said window tracks said analog signal value as said signal changes from one value to another during stable system conditions for said analog signal to be located at a predetermined location within said window.

9. The method of claim 8 wherein said analog signal is balanced within said window.

10. The method of claim 3 further including a second window defining a range of acceptable motion of said one object to the other of said objects, said second window tracking said analog signal value in response to movement of said one object to the other of said objects resulting from external system conditions.

11. The method of claim 10 wherein said second window tracks said analog signal value changes resulting from seasonal and climatic changes which effect the physical dimensions of said objects.

12. A security system indicating relative displacement between a first unit and a second unit, comprising:

means in one unit generating a signal having characteristics representing the relative displacement between said units;

means receiving and processing said signal; and, means generating a window representing a range of signal characteristic values which are a function of a range of acceptable motion through which said one unit may move relative to said other unit without putting said security system into an alarm condition, said range of acceptable motion defining the size of said window.

13. The security system of claim 12 in which said window includes a first range of acceptable motion representing a normal no-alarm range of motion between said first and second units; but also including, during start-up or reset of the system, a second range of acceptable motion, significantly less than the first said range, representing the no-alarm distance between the first and second units, said second range of motion being only for a predetermined time period to accommodate for small distances of relative movement of one unit relative to the other unit, thus minimizing potential false alarms.

14. The security system of claim 13 wherein said second range of acceptable motion defined by said window is included within said first range of acceptable motion defined by said window.

15. The security system of claim 12 wherein said means generating said signal includes means generating a magnetic field.

16. The security system of claim 12 wherein said means generating said signal includes means generating an optical signal.

* * * * *

UNITED STATES PATENT AND TRADEMARK OFFICE

CERTIFICATE OF CORRECTION

PATENT NO. : 5,936,522
DATED : August 10, 1999
INVENTOR(S) : Vogt

It is certified that error appears in the above-identified patent and that said Letters Patent is hereby corrected as shown below:

Column 13, Claim 5,
Line 34, "2" should read -3 — (as noted in examiner's amendment dated 9/1/1998)

Signed and Sealed this

Twenty-first Day of August, 2001

*Attest:*

Nicholas P. Godici

*Attesting Officer*

NICHOLAS P. GODICI
*Acting Director of the United States Patent and Trademark Office*